United States Patent [19]

Mazzamauro et al.

[11] Patent Number: 4,661,813

[45] Date of Patent: Apr. 28, 1987

[54] MAGNETIC LATCHING AND DAMPING FOR ELECTROMAGNETIC INDICATORS

[75] Inventors: Robert Mazzamauro; John Ambrozaitis, both of Waterbury, Conn.

[73] Assignee: Minelco, Inc., Thomaston, Conn.

[21] Appl. No.: 692,793

[22] Filed: Jan. 18, 1985

[51] Int. Cl.[4] ..... G08B 5/00

[52] U.S. Cl. ..... 340/815.26; 340/815.05

[58] Field of Search ..... 340/815.01, 815.05, 340/815.26, 815.29, 815.31

[56] References Cited

U.S. PATENT DOCUMENTS

| | | | |
|---|---|---|---|
| 2,245,493 | 6/1941 | Nothe | 340/815.26 |
| 2,367,299 | 1/1945 | McLarn et al. | 340/815.26 |
| 3,210,758 | 10/1965 | Huston | 340/815.26 X |
| 3,704,462 | 11/1972 | Pihl | 340/815.26 |
| 3,731,303 | 5/1973 | Wohlbach | 340/815.26 |
| 3,772,686 | 11/1973 | Chardon | 340/815.26 |
| 3,781,876 | 12/1973 | McComb | 340/815.26 X |
| 4,115,769 | 9/1978 | Hart et al. | 340/815.26 |
| 4,243,978 | 1/1981 | Winrow | 340/815.26 |

*Primary Examiner*—Gerald L. Brigance
*Assistant Examiner*—Vincent P. Kovalick
*Attorney, Agent, or Firm*—Pennie & Edmonds

[57] ABSTRACT

A binary indicator for providing an indication of a normal or malfunction condition of equipment being monitored, the indicator having a magnetic latching and damping arrangement which ensures that the indicator functions properly under typical random high vibrational operating conditions. The latching and damping arrangement includes three auxiliary magnets which are located in close proximity to a rotating bar magnet to which a rotatable disc shaped indicator member is attached. The auxiliary magnets are positioned so that they prevent the rotating bar magnet from slipping out of the normal or "set" position into the malfunction or "fault" position or from slipping out of the "fault" position into the "set" position. Additionally, the auxiliary magnets dampen the movement of the rotating bar magnet when the bar magnet is reset to the "set" position from the "fault" position. The first auxiliary magnet is positioned in close proximity to a first end of the bar magnet when it is in the "set" position. The second auxiliary magnet is positioned in close proximity to the same first end of the bar magnet when the bar magnet is in the "fault" position. The third auxiliary magnet is positioned in close proximity to the second end of the bar magnet when it is between the "set" and the "fault" position but not exactly centered between these two positions.

16 Claims, 10 Drawing Figures

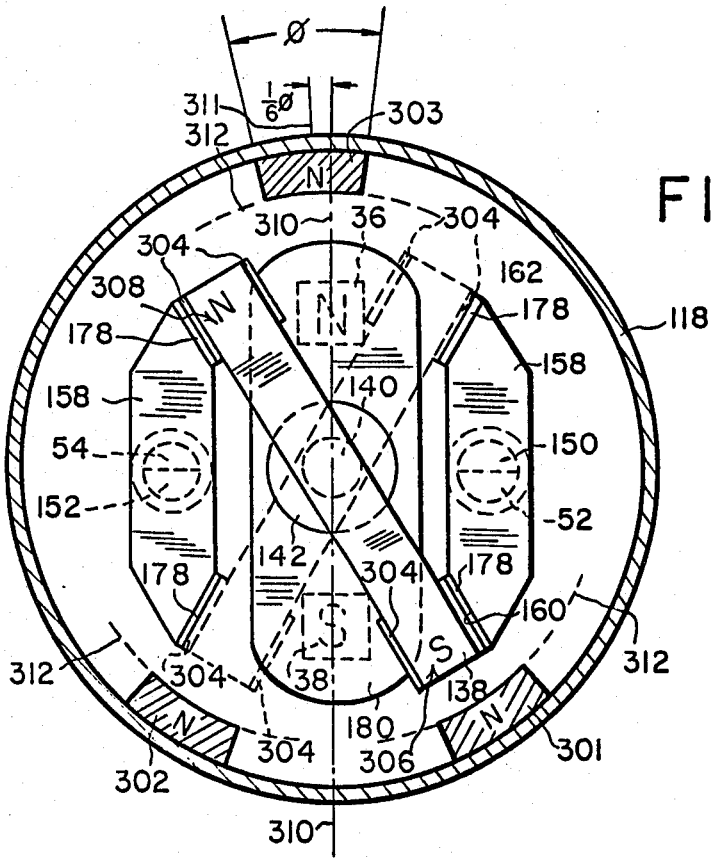
FIG. 9A
FIG. 9B
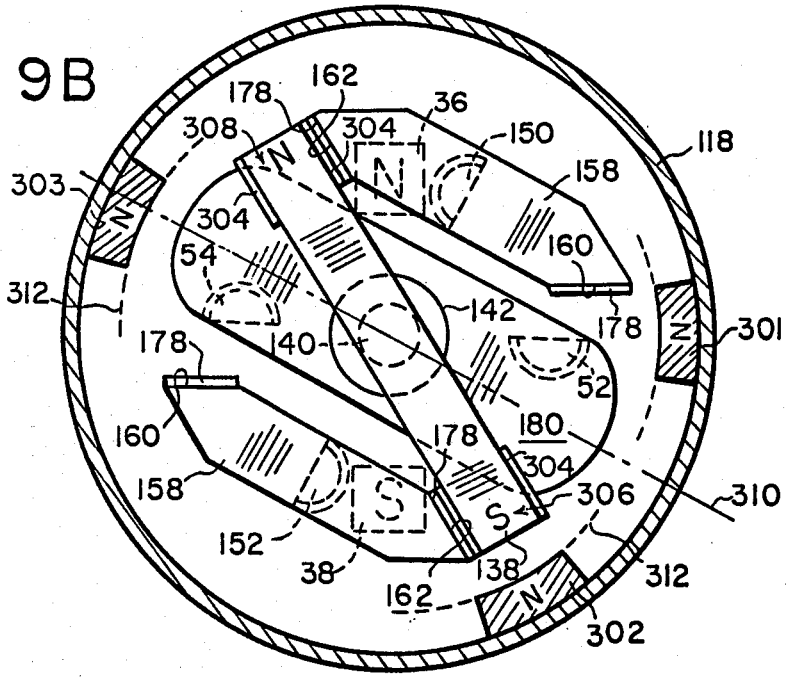

MAGNETIC LATCHING AND DAMPING FOR ELECTROMAGNETIC INDICATORS

TECHNICAL FIELD

The present invention relates to a form of electromagnetic indicator capable of binary indication of a fault or malfunction condition, for example, through movement of one of a pair of movable indicator discs.

BACKGROUND OF THE INVENTION

Many forms of binary electromagnetic indicators presently exist in the prior art. Two prior art forms of binary electromagnetic indicators are disclosed in U.S. Pat. No. 3,704,462 issued to George E. Pihl on Nov. 28, 1972 and in U.S. Pat. No. 4,115,769 which issued Sept. 19, 1978 to Robert D. Hart and Robert Mazzamauro, both of which patents are incorporated herein by reference.

The Pihl and Hart patents each describe an electromagnetic indicator which is responsive to a fault or malfunction condition, whereby one of a pair of cooperating indicator members, each of which is disc-shaped and mounted along a common axis, rotates relative to the other to change a visual display. Both of the indicator members have a plurality of sectors of like size. The sectors of the stationary indicator member are alternately transparent and opaque, while the sectors of the movable indicator member are totally opaque although alternately distinguishable. In these patents the alternate sectors of the movable indicators are white and dark and the opaque sectors of the stationary indicator member are also dark. For example, the dark sectors of both indicator members may be colored with a black paint. Thus, in one position, the "set" position, the black sectors of the movable indicator member align with black sectors on the stationary indicator member and the white sectors of the movable indicator member align with transparent sectors of the stationary indicator member. In the position to which the movable indicator member moves as a result of a fault or malfunction condition, the opposite alignment will be seen. An alignment of the sectors of the movable indicator member also may be employed such that in the "set" position its black sectors align with the transparent sectors of the stationary indicator member. For purposes of the following description of the invention, particularly in the discussion of the operation of the electromagnetic indicator, it will be assumed that in the "set" position of the indicator members, the display will be totally black and that in the "fault" position of the indicator members, the display will show alternating black and white sectors.

Electromagnetic indicators, such as the electromagnetic indicators disclosed in the Pihl and Hart patents, while generally acceptable, have been found to suffer from certain disadvantages. These disadvantages relate to the ability of the indicator to function properly under typical random high vibrational operating conditions. Since such electromagnetic indicators are frequently used as fault indicators in air craft, the indicators are regularly subjected to severe vibrations and shocks and to strong forces which arise during taking off, landing and maneuvering of the aircraft. Under such adverse operating conditions, previously available electromagnetic indicators frequently slip accidentally from the "set" position to the "fault" position, thereby causing the indicator to display an erroneous reading.

SUMMARY OF THE INVENTION

The present invention is an improvement over the electromagnet indicators disclosed by Pihl and Hart in that the electromagnetic indicator of the present invention provides a new magnetic latching and damping arrangement which ensures that the indicator functions properly under typical random high vibrational operating conditions. The latching and damping arrangement includes three auxiliary magnets which are located in close proximity to a rotating bar magnet to which one of the disc-shaped indicator members is attached. The auxiliary magnets are positioned so that they prevent the rotating bar magnet from slipping out of the "set" position into the "fault" position and so that they do not adversely effect normal functioning of the indicator. The magnetic fields generated by these three auxiliary magnets are strong enough to latch the rotating bar magnet in the "set" position until a malfunction condition occurs. The auxiliary magnets also latch the rotating bar magnet in the "fault" position after a malfunction condition has occurred. Additionally, the auxiliary magnets dampen the movement of the bar magnet when the bar magnet is reset to the "set" position from the "fault" position.

The three auxiliary magnets are positioned around the inside surface of the bearing cup within which the rotating magnet is rotatably mounted. The first auxiliary magnet is positioned in close proximity to a first end of the bar magnet when it is in the "set" position. The second auxiliary magnet is positioned in close proximity to the same first end of the bar magnet when the bar magnet is in the "fault" position. The magnetic polarization of the faces of the first and second auxiliary magnets adjacent to the first end of the bar magnet are such that the first end of the bar magnet is magnetically attracted to the first and second auxiliary magnets. The third auxiliary magnet is positioned in close proximity to the second end of the bar magnet when it is between the "set" and the "fault" position but not exactly centered between these two positions. The magnetic polarization of the face of the third auxiliary magnet adjacent to the second end of the bar magnet is such that the second end of the bar magnet is magnetically repelled by the third auxiliary magnet. Advantageously, the third auxiliary magnet is positioned so that it is closer to the "set" position of the bar magnet than to the "fault" position of the bar magnet, preferably so that two thirds of the third auxiliary magnet is on the "set" side of the midpoint between the "set" and "fault" positions of the magnet.

Although three discrete auxiliary magnets are illustratively used, a ring of material can be used which has three areas of magnetization which are appropriately positioned and have the appropriate magnetic polarization.

The indicator of the present invention is extremely insensitive to shock, vibration or orientation in a supporting panel, has a fast response, requires low input power, and, by providing black and white opaque sectors on the movable indicator member, provides a relatively easily discernible display under any condition of ambient light to indicate whether there has been a fault or malfunction of the device which is being monitored.

BRIEF DESCRIPTION OF THE DRAWINGS

These and other objects, features, elements, and advantages of the invention will be more readily apparent from the following description of the invention, in which:

FIGS. 9A and 9B are schemat:c top plan views as seen along the line 9—9 in FIG. 1 illustrating the resetting structure in the normal position and in the position to which it is rotated, respectively, to return the indicator members to the "set" position.

DESCRIPTION OF THE PREFERRED EMBODIMENT

Figure 1:
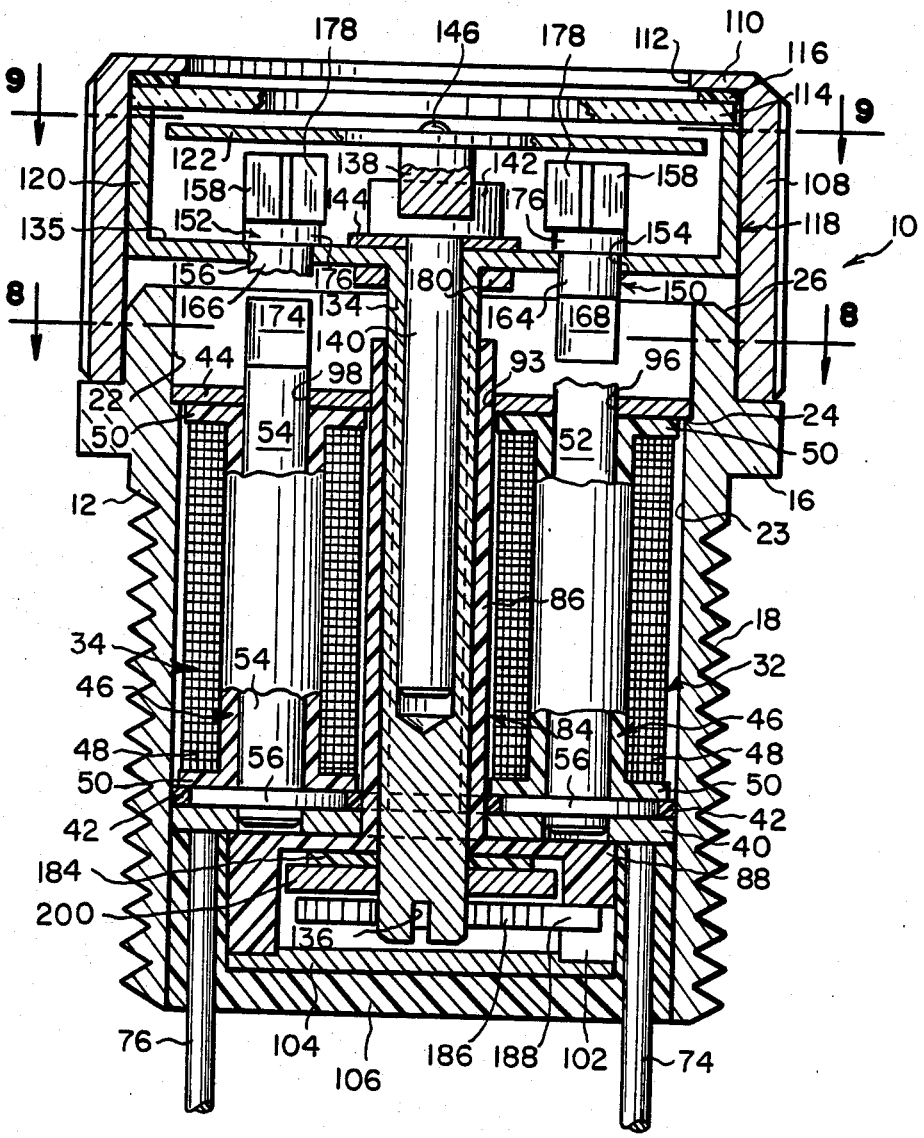
FIG. 1 is a side elevation in vertical section of a preferred embodiment of the electromagnetic indicator of the present invention.
Figure 2:
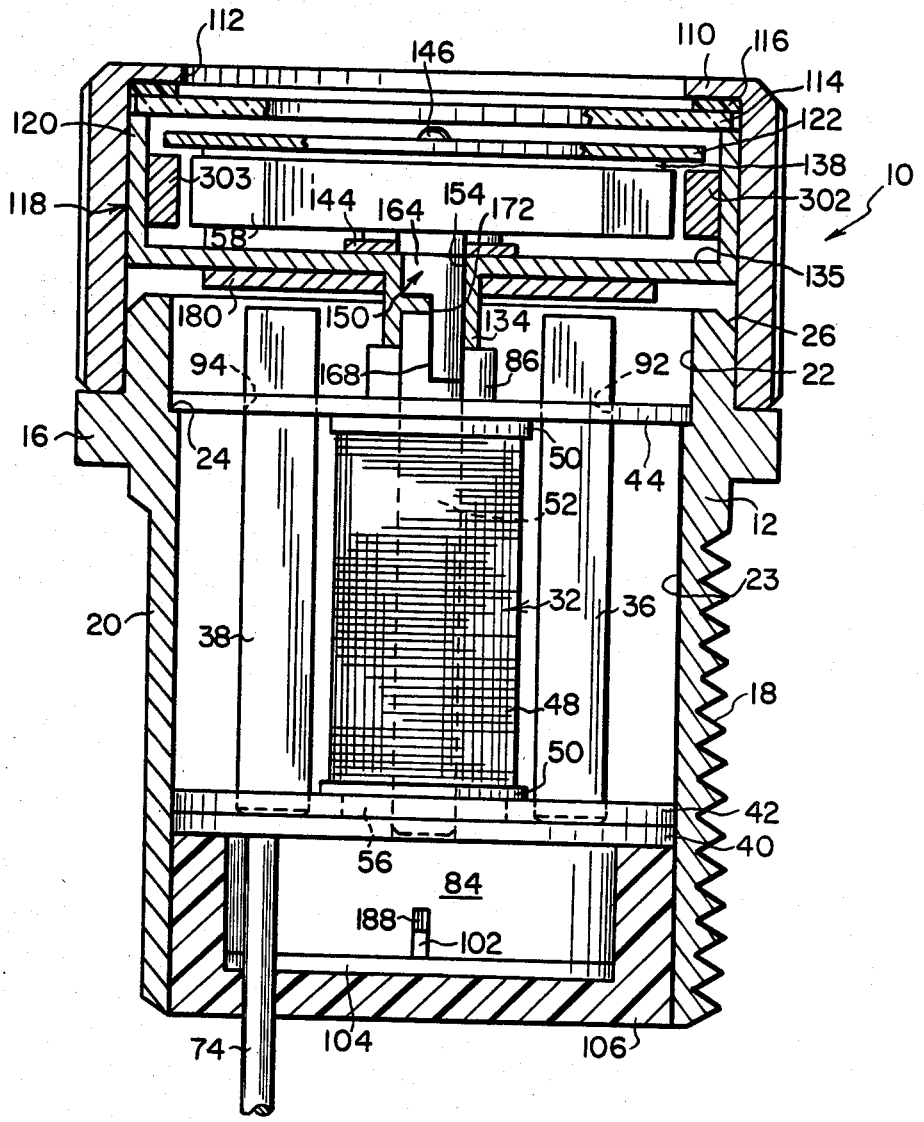
FIG. 2 is a side elevation, partially in section, of the structural components of FIG. 1 rotated through an angle 90°.

The electromagnetic indicator, denoted by the numeral 10, and hereinafter the "indicator", is illustrated in FIGS. 1 and 2, while various of the operative components of the indicator may be seen in the other figures.

With reference to FIG. 1, the indicator 10 includes a housing 12 which overall is of cylindrical outline and has an exterior flange 16 disposed near the front end. The housing below the flange is threaded therealong as at 18, the thread being interrupted by a land portion 20 which assures that the housing will be received in proper orientation by a panel (not shown) of an instrument whose fault or malfunction condition is to be monitored. The housing may be mounted on and secured to the panel in any manner such as by a threaded lock nut (not shown) to draw the flange toward the panel.

The interior of housing 12 is formed by a pair of concentric cylindrical surfaces 22, 23 connected by a shoulder 24. The front end of the housing may be beveled outwardly as at 26 to facilitate mounting of the knob assembly of the indicator, as hereinafter described.

For reasons that will become apparent, housing 12 is preferably fabricated of a non-magnetic metal or of a plastic having the characteristics of strength, rigidity, and impact strength among others as is appropriate for use as a support structure.

A base assembly is received within housing 12, and a knob assembly is received partially within housing 12 and partially on housing 12 over bevel 26 at the front end. The base assembly comprises generally the stationary portion of the indicator, while the knob assembly comprises generally the movable portion of the indicator.

The base assembly, as illustrated in FIGS. 1 and 2, includes a pair of electromagnets 32 and 34 and a pair of permanent magnets 36 and 38 (hereinafter "reset magnets") arranged in quadrature and at substantially equal radii. Both pairs of magnetic structure are supported by a core return member 40 (hereinafter "core return") and printed circuit tabbing board 42 (hereinafter "tabbing board") at one end and a disc 44 near the other end.

Each of the electromagnets includes a bobbin 46 fabricated of an insulating material, for example, plastic. A coil 48 is wound a number of turns on each of the bobbins 6 within a region bounded at opposite ends by flanges 50. The number of turns and the gauge of the wire will be determined by factors, such as the power of the source of the input, the desired resistance and other operational factors as are well known. A core member 52 is disposed within the central hollow of bobbin 46 of electromagnet 32 and a similar core member 54 is disposed within the central hollow of bobbin 46 of electromagnet 34. Each of the core members includes a flange 56 adjacent one end. Flange 56 engages between an outer surface of the bobbin at one end and the core return 40 (see FIGS. 1 and 2).

Figure 3:
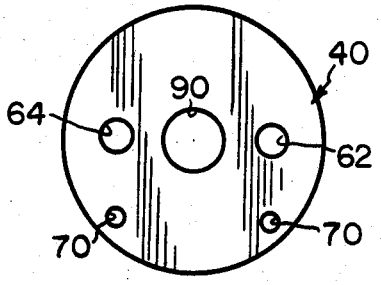
FIG. 3 is a plan view of a core return member of the present invention.
Figure 4:
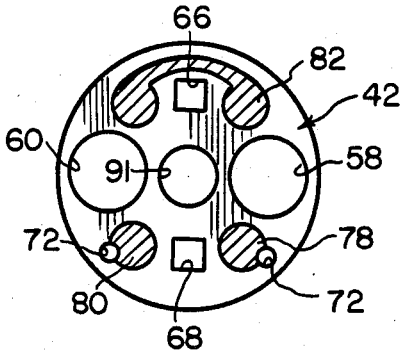
FIG. 4 is a plan view of a printed circuit tabbing board of the present invention.

As may be seen in FIGS. 3 and 4, core return 40 and tabbing board 42 are of disc shape, and are juxtaposed to support both pairs of magnetic structure. Tabbing board 42 includes a pair of cutouts 58 and 60 which are of an outline complementary to the outline of flange 56 of each of core members 52 and 54 received therethrough. Core return 40 similarly includes a pair of cutouts 62 and 64. The axis of each cooperating pair of cutouts 58, 62 and 60, 64 are located on a common diameter and at equal radii. Cutouts 62 and 64 are smaller in size to accommodate the ends of the core members 52 and 54, both of which terminate at a plane between opposed surfaces of core return 40. Tabbing board 42 includes a second pair of cutouts 66 and 68 located substantially at equal radii although substantially at angles of 90° from the axes of cutouts 58 and 60. Cutouts 66 and 68 are of an outline complementary to the outline of reset magnets 36 and 38. The magnetic structures may be of any outline or configuration. For example, in the embodiment illustrated, cutouts 66 and 68 are rectangular to accommodate the ends of reset magnets 36 and 38, respectively. As seen in FIG. 2, one end of reset magnets 36, 38 is supported on the surface of core return 40 in a manner similar to the support of flange 56 of core members 52 and 54.

Core return 40 is formed of soft iron or other highly magnetically permeable material and tabbing board 42 is formed of a magnetically and electrically insulating material which may be plastic.

Referring to FIGS. 3 and 4, core return 40 and tabbing board 42 include two pairs of openings 70 and 72, respectively. These openings are coaxially disposed, and, when discs 40 and 42 are in juxtaposition, the ends of terminal leads 74 and 76 are received therethrough. Openings are formed adjacent a pair of lands 78 and 80, each of which is provided with a conductive coating, such as copper. A land 82 similarly provided with a conductive coating, which may be copper, is separate from the lands 78 and 80. Land 82 may be of the shape of a dumbbell, as seen in FIG. 4. Coils of electromagnets 32 and 34 are arranged in series (see FIG. 7) through attachment of one end of each coil to the remote portions of land 82 while the other end of each coil is attached to lands 78 and 80.

The base assembly additionally includes a member 84 including a sleeve 86 whose interior communicates with a housing 88. Member 84, is also formed of a non-magnetic material, such as a plastic and preferably a rigid plastic.

Sleeve 86 is of a length to extend through a pair of openings 90 and 91 formed along the central axis of core return 40 and tabbing board 42, respectively (see FIGS. 3 and as well as through and slightly beyond an opening 93 in disc 44 (see FIG. 1). The inner diameter of the openings and the outer diameter of sleeve 86 are chosen so that a snug fit results.

Disc 44 additionally includes a further set of openings 92, 94 and 96, 98 (see FIGS. 1 and 2) to accommodate, respectively, the other end of reset magnets 36 and 38 and the other end of core members 52 and 54. The ends of each of the reset magnets 36, 38 and core members 52, 54 extend beyond the end of sleeve 86 of member 84, and terminate within housing 12 when the base assembly is fully received.

Housing 88 of member 84 is cup-shaped in outline including a cylindrical wall or skirt in which there is an opening 102. Housing 88 is closed by a cover 104 secured at the base of the cup of housing 88 in any convenient manner. An adhesive or suitable fasteners as are well known in the art may be employed for this purpose. Member 84 is received in the base assembly such that the upper surface of housing 88 is in juxtaposition to the lower surface of core return 40 (FIGS. 1 and 2). A potting material 106 can be deposited around the cup of the base of housing 88 and over cover 104 to hermetically seal the lower end of case 12. Disc 44 closes the other end of housing 12. The inner diameter of cylinder surfaces 22 and the outer diameter of the disc 44 are such that there is a tight frictional engagement at shoulder 24. However, indicator 10, at the upper end of the housing 12, can be sealed in a more permanent manner by potting material (not shown) deposited at the outer periphery of disc 44, as well as around openings 92 and 98 in disc 44 for reset magnets 36 and 38, core members 52 and 54 and sleeve 86.

The knob assembly comprising the movable portion of indicator 10, as shown in FIG. 1, includes a knob 108 having a cylindrical body and a flange 110 at one end. Flange 110 extends inwardly to define the outline of an opening 112 which provides a viewing window. An indicator disc 114 comprising one of a pair of flag members of the indicator 10 is fixed behind the viewing window. Indicator disc 114 (hereinafter "stationary flag") is positioned juxtaposed to a resilient gasket 116 of annular shape disposed behind flange 110 to provide a cushion support for stationary flag 114 which is immobilized in movement relative to the knob by a bearing cup 118 received by a frictional fit within knob 108. Bearing cup 118 is positioned so that a rim of skirt 120 coacts with the other surface of the stationary flag.

An indicator disc 122 comprising the second of the pair of flag members of indicator 10 cooperates with stationary flag 114, as described in detail below, to indicate a "fault" or malfunction condition on the one hand and a "set" or normal condition on the other hand. As described, the display depends upon the rotational position of indicator disc 122 (hereinafter "movable flag") relative to stationary flag 114.

Figure 5:
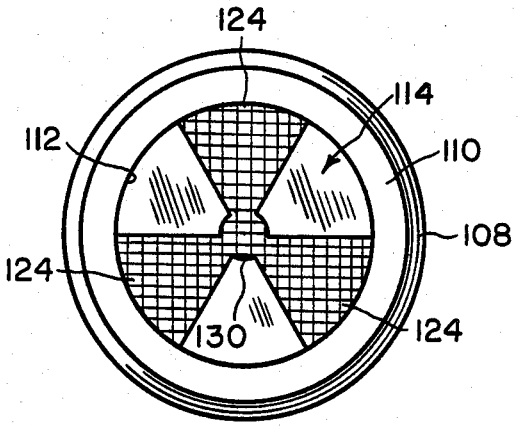
FIG. 5 is a front end view of the reset ring of the electromagnetic indicator of the present invention including one of the indicator members.
Figure 6:
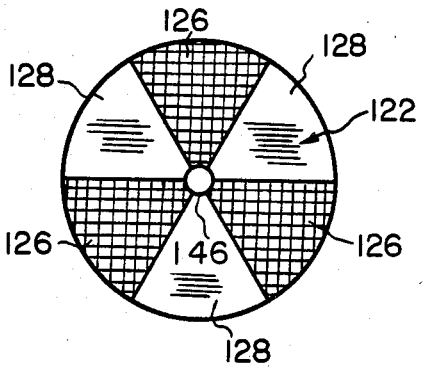
FIG. 6 is a plan view of a second of the indicator members.

As illustrated in FIGS. 5 and 6, stationary and movable flags 114 and 122, respectively, are provided with a first plurality of sectors 124 and 126, respectively, spaced apart by a second plurality of sectors of a size substantially equal to the size of first plurality of sectors 124 and 126. Stationary flag 114 is preferably formed of a transparent material and sectors 124 are coated with a dark opaque paint, illustratively black in color. Movable flag 122 may be formed similarly of any material which is preferably opaque. Sectors 126, however, will be like sectors 124 and the intervening sectors 128 will contrast therewith. Thus, sectors 128 may be coated, for example, with white paint. Sectors 124 of stationary flag 114 merge into and form an area 130 concentric with the axis of the stationary flag which obscures the area at the apices of the sectors of movable flag 122.

The outer surface of knob 108 is preferably serrated to enhance grippability of the knob in resetting of movable flag 122 from the "fault" position to the "set" position, as will be discussed hereinafter.

Bearing cup 118 includes a shaft 134 which extends from a base surface 135 connecting with skirt 120. Shaft 134 is hollow throughout at least a substantial portion of its length from the base surface and a slot 136 is cut or otherwise formed at its end. Slot 136 is disposed across a diameter and is of a width and depth for purposes also set out below.

Skirt 120 of bearing cup 118 provides a chamber within which movable flag 122 is free to rotate upon the occurence of a fault or malfunction condition of the instrument being monitored, and by this rotation relative to stationary flag 114 provide one of the binary indications of a fault or malfunction condition ("fault") on the one hand, and normal condition ("set") on the other hand.

Movable flag 122 is fastened to a bar magnet 138 which, in turn, is supported by a shaft 140 through an interposed hub 142. Any particular manner of attachment may be used. A washer 144 fits loosely on shaft 140. Washer 144 acts as a bearing between base surface 135 and hub 142 when shaft 140 is received into the hollow length of shaft 134.

Movable flag 122 is provided with an axial protuberance 146 which extends toward the inner surface of stationary flag 114. The protuberance acts as a thrust bearing thereby substantially preventing axial movement of shaft 140 relative to bearing cup 118.

A pair of stop members 150 and 152 are supported by bearing cup 118 within a pair of openings 154 and 156 (see FIG. 1) in base surface 135. The axes of openings 154 and 56 are disposed along a diameter and at equal radii from the axis of shaft 134. The axes of the openings in the normal position of bearing cup 118 are coaxial with the axes of core members 52 and 54, respectively. Stop members 150 and 152 each include an upper generally rectangular body 158 (see FIG. 9A and 9B) having ends which taper symmetrically toward their respective major axes. The tapered surfaces are denoted by the numerals 160 and 162. Stop members 150 and 52 each also include a pin portion 164 and 166, respectively. Pin portions 164 and 166 extend through openings 154 and 156 respectively, thereby engaging with extensions of core members 52 and 54, respectively, in the normal position of the bearing cup 118 and with the ends of reset magnets 36 and 38, respectively, in the position to which the bearing cup 118 moved to reset movable flag 122 to the "reset" position. The two positions of bearing cup 118 are further described below is detail when FIGS. 9A and 9B are discussed. As may be seen in FIGS. 1 and 2, pin portions 164 and 166 are cylindrical in cross section with a half section removed within the region of the end to provide a flat face. Thus, pin portion 164 includes a flat face 168 and pin portion 166 includes a flat face 170. The extensions of core members 52 and 54 are similarly formed to provide flat faces 172 and 174, respectively.

Stop members 150 and 152 are anchored such that their major axes are always parallel. A stop section 176 is formed on each pin portion near body 158 (see FIG.

1). Stop section 176 comprises a length of greater diameter and maintains a slight spacing between body 158 and base surface 135 of bearing cup 118, thereby positioning body 158 in the path of movement of bar magnet 138. Additionally, stop members 150 and 152 are anchored so that flat faces 168 and 170 are oppositely disposed. Flat faces 172 and 174 formed in the extensions of core members 52 and 54 also are oppositely disposed to cooperate with flat faces 172 and 174 with a lap connection.

Stop members 150 and 152 are formed of a magnetic material such as soft iron, steel or any other highly permeable magnetic alloy. Core members 52 and 54 are preferably formed of similar material. As has been described, when bearing cup 118 is in one rotational position, i.e., the normal position or "set" position, pin portions 164 and 166 engage and form an extension of core members 52 and 54, and, when bearing cup 118 is moved to a second rotational position, or "reset" position, to reset the movable flag, pin portions 164 and 166 engage and form extensions of reset magnets 36 and 38.

Bar magnet 138 is parallelepiped in outline and has freedom of movement rotationally within limits defined by the positioning of stop members 150 and 152 and has two ends 306 and 308. The limit of movement of bar magnet 138 in one direction of rotation is defined by tapered surfaces 160, while in the other direction of rotation it is defined by tapered surfaces 162. Stop pads 178 on tapered surfaces 160 and 162 and stop pads 304 on bar magnet 138 prevent bar magnet 138 from a direct surface-to-surface contact with the respective tapered surfaces 160 and 162. Stop pads 178 and 304 are formed of a non-magnetic material or may be in the form of a coating such as "TEFLON" or the equivalent having a low coefficient of friction for non-sticking engagement and for spacing. "TEFLON" has proved satisfactory.

As shown in FIG. 2 and in detail in FIGS. 9A and 9B, three auxiliary magnets 301, 302, and 303 are fixed to the inner surface of bearing cup 118. The exact positions of auxiliary magnets 301, 302 and 303 are discussed more fully below with reference to FIGS. 9A and 9B.

A shunt member 180 (see FIGS. 9A and 9B) in the form of an elongated, flat, plate is received immovably around shaft 134 of bearing cup 118. Shunt member 180 is adjacent the lower surface of bearing cup 118 and, because of its mounting onto shaft 134, moves with bearing cup 118 but remains in a position such that its longitudinal axis is in alignment with the major axes of stop members 150 and 152. However, depending upon the position of the knob assembly, shunt member 180 is disposed so that its longitudinal axis is substantially coincident with an imaginary line connecting either reset magnets 36 and 38 or core members 52 and 54. Shunt member 180 is of a length sufficient to traverse at least the distance between an extension of the axes of each pair of magnetic structures. Shunt member 180 may be formed of a magnetic material such as stainless steel (type 430).

Shaft 134 of bearing cup 118 is received within sleeve 86 of member 84 so that slot 136 is within the area bounded by the cup of housing 88.

The knob assembly is secured in place by means of a washer 184 and a disc 200 which fit over the bottom end of shaft 134 within the cup of housing 88. Washer 130 functions as a spacer and may be made of any suitable material. Preferably, it is made of "TEFLON" so as to reduce friction. Disc 200 acts to retain shaft 134 so that it cannot be pulled out of the cup of housing 88. Ring 200 may be secured to shaft 134 in any convenient manner. Preferably, it is a Waldes Truarc ring, which is well known to persons skilled in the art. This type of ring makes a friction grip with shaft 134 sufficiently strong so that it will not slip on shaft 134. Ring 200 prevents axial movement of shaft 134 out of sleeve 86. Completing the device is a helically wound spring 186. The inner end of spring 186 is positioned in slot 136 of shaft 134, while the outer end 188 of spring 186 extends into and is captivated by slot 102 of the cup of housing 88. As previously stated, the end of housing 88 is closed by a cover 104. The cover will provide a support surface for the body of spring 186.

Spring 186 is pre-stressed and acts to return the knob assembly to the normal or "set" position.

Figure 7:
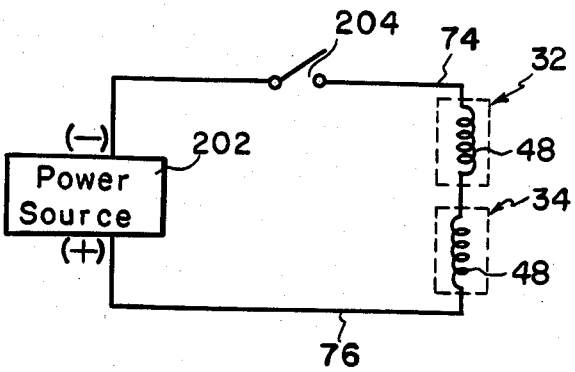
FIG. 7 is a schematic illustration of an operating circuit to which the electromagnetic indicator may be connected.

FIG. 7 illustrates a possible circuit arrangement whereby coils 48 of electromagnets 32 and 34 are connected in series to a power source 202, such as a battery, through a switch 204.

Referring to FIG. 9A which shows the knob assembly in the normal or "set" position, the exact positions of the three auxiliary magnets 301, 302 and 303 can be seen. In FIG. 9A, bar magnet 138 is shown in the "set" position in solid lines and in the "fault" position in broken lines. All three auxiliary magnets are fixed to the inner surface of bearing cup 118 so that one pole of each auxiliary magnet is directed toward the center of bearing cup 118. First auxiliary magnet 301 is positioned on the inner surface of bearing cup 118 so that it is in close proximity to a first end 306 of bar magnet 138 when bar magnet 138 is in the "set" position Second auxiliary magnet 302 is positioned on the inner surface of bearing cup 118 so that it is in close proximity to first end 306 of bar magnet 138 when bar magnet 138 is in the "fault" position. Third auxiliary magnet 303 is positioned on the inner surface of bearing cup 118 so that it is in close proximity to a second end 308 of bar magnet 138 when bar magnet 138 is between the "set" and "fault" positions. Advantageously, third auxiliary magnet 303 is positioned on the inner surface of bearing cup 118 so that it lies substantially on an imaginary line 310 which passes through the center of shunt member 180 along its length as shown in FIGS. 9A and 9B. Preferably, third auxiliary magnet 303 is positioned so that two thirds of third auxiliary magnet 303 is on the side of imaginary line 310 closest to second end 308 of bar magnet 138 when bar magnet 138 is in the "set" position. This is illustrated in FIG. 9A where the third auxiliary magnet 303, which subtends the angle $\phi$, is shown to be offset by one-sixth this angle. This, line 311 which runs through the center of the third auxiliary magnet 303 is a distance of one-sixth $\phi$ from the imaginary line 310.

Although auxiliary magnets 301, 302 and 303 are shown as three discrete magnets, a magnetically spotted ring can alternatively be used as shown by broken lines 312 in FIG. 9A. Ring 312 is magnetically spotted at the three positions where auxiliary magnets 301, 302 and 303 would otherwise be located and is inserted and fixed within bearing cup 118. Ring 312 is similar to a plastiform motor ring used in the manufacture of fractional horsepower motors which are typically used in clocks and timers.

Alternatively, the individual auxiliary magnets are fixed at their appropriate positions within a thin ring (not shown) which is inserted and fixed within bearing cup 118.

Figure 8:
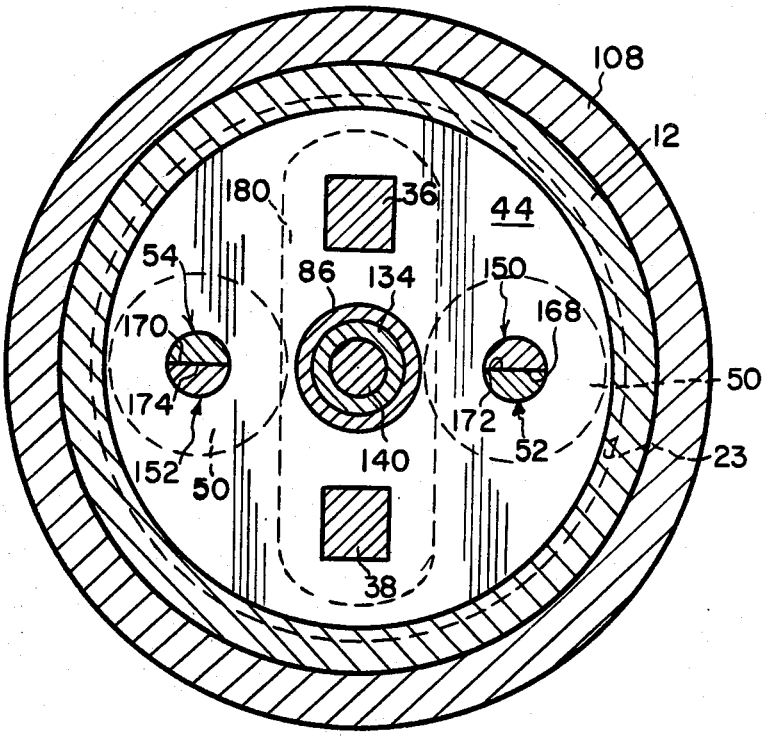
FIG. 8 is a sectional view as seen along the line 8—8 in FIG. 1.

The operation of indicator 10 now will be described. Initially, referring to FIGS. 8, 9A and 9B, the positioning of the knob assembly, determined by the elastic action of spring 186, is such that flat faces 168 and 170 of pin portions 164 and 166 of stop members 150 and 152 engage flat faces 172 and 174 of cores 52 and 54 of electromagnets 32 and 34, respectively. Assuming that the magnetic polarity of each of auxiliary magnets 301, 302 and 303, reset magnets 36 and 38, and bar magnet 138 are as illustrated in FIGS. 9A and 9B, and that FIG. 9A represents the "set" position of stop members 150 and 152, bar magnet 138 will be in engagement with oppositely disposed tapered surfaces 160 of stop members 150 and 152 and shunt member 180 will extend over the ends of reset magnets 36 and 38. Movable flag 122 is secured to bar magnet 138 so that its black sectors 126 are in alignment with transparent sectors 128 of stationary flag 114. Thus, indicator 10 provides as indication at viewing window 112 which is totally opaque black.

The magnetic field from the north (N) pole of first auxiliary magnet 301 attracts the south (S) pole of the first end 306 of bar magnet 138. In addition, the magnetic field from the north (N) pole of third auxiliary magnet 303 repels the north (N) pole of the second end 308 of bar magnet 138. This combination of magnetic attraction and repulsion of bar magnet 138 in the "set" position helps to maintain bar magnet 138 in the "set" position even when indicator 10 and bar magnet 138 are subjected to severe vibrations and shocks.

If terminal leads 74 and 76 of indicator 10 are coupled to source of power 202, as discussed above, and switch 204 is closed momentarily to provide a current pulse through the series connected coils 48, the coils which are oppositely wound will generate opposite poled magnetic fields. If bar magnet 138 is in the position of FIG. 9A such that its north (N) pole engages stop member 152 and its south (S) pole engages stop member 150, the current applied to two coils 48 must be such that the upper end of core 52 becomes a south (S) pole and the corresponding end of core 54 becomes a north (N) pole. Stop members 150 and 152 will be similarly polarized, and, as a result, bar magnet 138 will be repelled from tapered surfaces 160. The magnetic field generated by stop members 150 and 152 must be such that the repulsive force between third auxiliary magnet 303 and second end 308 of bar magnet 138 and the attractive force between first auxiliary magnet 301 and first end 306 of bar magnet is exceeded. As a result of the strong repulsive forces generated between stop members 150 and 152 and bar magnet 138, bar magnet 138 rotates in a clockwise direction to the other limit position or the "fault" position whereby bar magnet 138 is in a position of engagement with tapered surfaces 162 of stop members 150 and 152. Movable flag 122 moves through a similar rotational angle to change the display. The magnetic flux between bar magnet 138 and tapered surfaces 160 of stop members 150 and 152 diminishes as the distance therebetween increases so that at some point in this clockwise travel, bar magnet 138 is influenced primarily by the attractive influence of the magnetic flux at tapered surfaces 162 of stop members 150 and 152. Additionally, the magnetic field from the north (N) pole of second auxiliary magnet 302 attracts the south (S) pole of first end 306 of bar magnet 138, and the magnetic field from the north (N) pole of third auxiliary magnet 303 repels the north (N) pole of second end 308 of bar magnet 138.

Once bar magnet 138 has reached the "fault" position, it is latched in position by auxiliary magnets 302 and 303. The magnetic field from the north (N) pole of second auxiliary magnet 302 attracts the south (S) pole of the first end 306 of bar magnet 138. In addition, the magnetic field from the north (N) pole of third auxiliary magnet 303 repels the north (N) pole of the second end 308 of bar magnet 138. This combination of magnetic attraction and repulsion of bar magnet 138 in the "fault" position helps to maintain bar magnet 138 in the "fault" position until indicator 10 is reset, even when indicator 10 and bar magnet 138 are subjected to severe vibrations and shocks.

The current pulse applied to two coils 48 indicative of a fault or malfunction of the monitored device need only have a duration which is long enough to assure that bar magnet 138 will reach and pass beyond the point where the attractive influence of the magnetic fields from tapered surfaces 162, and the attractive and repulsive influences from second and third auxiliary magnets 302 and 303, respectively, together with the rotational momentum of rotating bar magnet 138 is strong enough to cause bar magnet 138 to continue to the other limit or "fault" position shown by the broken lines of FIG. 9A. Prior to application of the current pulse, bar magnet 138 is magnetically latched to tapered surfaces 160 and after the application of the current pulse, bar magnet 138 is magnetically latched to tapered surfaces 162 by auxiliary magnets 301, 302 and 303.

The change in position of bar magnet 138 and movable flag 122 causes the sectors 128 of the movable flag 122 to relocate to a position of alignment with the transparent sectors of the stationary flag 114 providing an indication at viewing window 112 which, as described, is alternately black and white. Movable flag 122 will remain in this position of orientation indicative of the occurrence of a fault or malfunction condition until reset by the resetting of knob assembly.

To reset indicator 10, the knob assembly is rotated from the orientation shown in FIG. 9A counterclockwise to the "reset" orientation shown in FIG. 9B. As the knob rotates, bearing cup 118, auxiliary magnets 301, 302 and 303, shunt member 180, and stop members 150 and 152 also rotate. The rotation of stop members 150 and 152 causes bar magnet 138 to rotate due to the physical contact between bar magnet 138 and tapered surfaces 162 of stop members 150 and 152. The knob assembly is rotated to the "reset" position shown in FIG. 9B at which pin portions 164 and 166 of stop members 150 and 152 are in engagement with the ends of reset magnets 36 and 38, respectively. The poles of the reset magnets 36 and 38 are disposed such that pin portion 164 engages a north (N) pole and pin portion 166 engages a south (S) pole. When this occurs, stop member 150 becomes a north (N) pole extension of reset magnet 36, while the other stop member 152 becomes a south (S) pole extension of reset magnet 38. The result is that bar magnet 138 is immediately repelled from the tapered surfaces 162 of stop members 150 and 152 and rotates further in the counterclockwise direction in return to its initial position of engagement with the tapered surfaces 160. The repulsive force between the north (N) pole of second end 308 of bar magnet 138 and the north (N) pole of third auxiliary magnet 303 acts to slow or dampen the counterclockwise rotation of bar magnet 138.

In resetting the indicator, in order to properly reset the indicator, the knob assembly should be held in the counterclockwise limit (or "reset" position) until the magnet has completed its further counterclockwise movement. When the knob assembly, which is moved against the elastic forces of spring 186, is released, it will immediately rotate in the clockwise direction to its original normal position at which flat faces 168 and 170 of stop members 150 and 152 again engage flat faces 172 and 174 of core members 52 and 54. Bar magnet 138 again, moves with stop members 150 and 152 when the knob assembly returns to the "set" position (FIG. 9A) at which sectors 126 of movable flag 122 are again in alignment with transparent sectors of the stationary flag 114. The visual indication in the "set" position also may be alternately black and white.

Shunt member 180 limits the magnetic influence of reset magnets 36 and 38 on bar magnet 138. Thus, since shunt member 180 is initially positioned over reset magnets 36 and 38 when indicator 10 is in the "set" position, shunt member 180 provides a low reluctance path for the magnetic flux of reset magnets 36 and 38 so as not to disturb the operation of bar magnet 138 by energization of coils 48 of electromagnets 32 and 34.

Movable flag 122 of indicator 10 may alternatively be reset electrically, as opposed to manually, by energizing coils 48 of electromagnets 32 and 34 with a current pulse of opposite polarity. In this embodiment, the source of power which has been described as a battery must be arranged in the circuit such that pulses of opposite polarity will be provided to the terminals 74 and 76. Thus, switch 204 is replaced by a switch capable of reversing the connections to the power source 202.

Illustratively, bar magnet 138 is about 0.385 inches long, about 0.062 inches (1.6 mm.) wide, and about 0.062 inches (1.6 mm.) thick and provides a magnetic field of about 350 gauss; auxiliary magnets 301, 302, and 303 are each about 0.075 inches (1.9 mm.) square and about 0.030 inches thick and provide a magnetic field of about 400 gauss; reset magnets 36 and 38 provide a magnetic field of about 900 gauss; bodies 158 are separated from one another by about 0.195 inches (4.9 mm.) and provide a magnetic field of at least about 800 gauss and preferably about 1200 gauss when electromagnets 32 and 34 are activated; the ends 306 and 308 of bar magnet 138 are separated from auxiliary magnets 301, 302, and 303 by a minimum distance of about 0.031 inches (0.8 mm.); stop pads 178 and 304 are each about 0.007 inches (0.2 mm.) thick; and third auxiliary magnet 303 is positioned on the inner surface of bearing cup 118 so that about 0.050 inches (1.3 mm.) of third auxiliary magnet 303 is on the side of imaginary line 310 closest to the second end 308 of bar magnet 138 when bar magnet 138 is in the "set" position.

While the invention has been described in conjunction with specific embodiments, it is evident that numerous alternatives, modifications, and variations will be apparent to those skilled in the art in light of the foregoing description.

For example, the positions of first and second auxiliary magnets 301 and 302, on the one hand, may be switched with the position of third auxiliary magnet 303, on the other hand, so that a mirror image of the positions of the auxiliary magnets shown in FIG. 9A results. Accordingly, first auxiliary magnet 301 is positioned in close proximity to second end 308 of bar magnet 138 when bar magnet 138 is in the "set" position; second auxiliary magnet 302 is positioned in close proximity to the second end 308 of bar magnet 138 when bar magnet 138 is in the "fault" position; and third auxiliary magnet 303 is positioned in close proximity to first end 306 of bar magnet 138 when bar magnet 138 is between the "set" and "fault" positions, so that two thirds of third auxiliary magnet 303 is on the side of imaginary line 310 closest to the first end 306 of bar magnet 138 when bar magnet 138 is in the "set" position The magnetic polarity of the inner faces of auxiliary magnets 301, 302, and 303 are, accordingly, south (S).

Alternatively, the poles of all the magnets as shown in FIG. 9A can be reversed so that all north (N) poles are south (S) poles and all south (S) poles are north (N) poles. The connections of coils 48 to power source 202 must also be reversed.

What is claimed is:

1. A bistable electromagnetic indicator for providing binary indication of first and second conditions comprising:

a housing;

first and second indicator discs supported on a central axis in coaxial spaced relation at one end of said housing and at least said first disc adapted for rotation about said axis whereby when said first disc is in a first of two bistable dispositions said discs indicate one of said conditions and whereby when said first disc is in a second bistable disposition said discs indicate the second of said conditions;

electromagnetic means including at least one electromagnet having a core and a winding therearound;

means adapted for connecting said winding to a source of current whereby said core of said electromagnetic means may be alternately polarized;

a first permanent magnet;

means immovably supporting said electromagnetic means and said first permanent magnet in said casing so that an end of said core and said first permanent magnet are directed axially and extend coextensively toward said discs;

a second permanent magnet having two ends disposed along a polar axis substantially normal to said central axis and having two magnetic poles disposed along said polar axis;

means supporting said second permanent magnet for rotation about said central axis between first and second limit positions, said second permanent magnet supporting said first indicator disc and moving said disc between said first and second limit positions which define said first and second bistable dispositions, respectively, said second permanent magnet being driven from said first to said second bistable disposition by magnetic forces upon application of a signal to said electromagnetic means;

flux permeable means that many be moved into mechanical engagement either with said core of said electromagnetic means, when the indicator is either in the first or second bistable position, or with said first permanent magnet, when the indicator is to be reset from said second bistable position, thereby to form an extension of said core of said electromagnetic means or said first permanent magnet, respectively, whereby said flux permeable means is magnetized in accordance with the magnetic field of said core of said electromagnetic means or said first permanent magnet, said flux permeable means disposed in the path of movement of said second permanent magnet for magnetically latching said second permanent magnet in one of said limit positions;

means for rotating said flux permeable means about said central axis from a position of engagement with said electromagnetic means to a position of engagement with said first permanent magnet, whereby said first indicator disc and said second permanent magnet are likewise moved about said central axis until said flux permeable means is repulsed to cause said first indicator disc and said second permanent magnet to move a further distance in the same direction of rotation to return to said first bistable disposition;

means biasing said flux permeable means toward said position of engagement with said electromagnetic means; and auxiliary magnetic latching means for aiding in magnetically latching said second permanent magnet in one of said limit positions, said auxiliary magnetic means comprising a plurality of auxiliary permanent magnets, the magnetic fields of said plurality of auxiliary magnets acting upon said second oermanent magnet so as to latch said second permanent magnet in one of said two limit positions until said flux permeable means is magnetized in accordance with the magnetic field of the magnetic means with which said flux permeable means is in contact with, either said core of said electromagnetic means or said first permanent magnet.

2. The indicator of claim 1 wherein said auxiliary magnetic latching means comprises:

a first auxiliary permanent magnet having two magnetic poles and positioned in close proximity to a first end of said second permanent magnet when said second permanent magnet is at said first limit position;

a second auxiliary permanent magnet having two magnetic poles and positioned in close proximity to said first end of said second permanent magnet when said second permanent magnet is at said second limit position; and a third auxiliary permanent magnet having two magnetic poles and positioned in close proximity to a second end of said second permanent magnet when said second permanent magnet is between said two limit positions.

3. The indicator of claim 2 wherein:

said second permanent magnet is disposed so that a first magnetic pole of said second permanent magnet is located at said first end of said second permanent magnet and a second magnetic pole of said second permanent magnet is located at said second end of said second permanent magnet;

a first pole of said first auxiliary permanent magnet is positioned in close proximity to a first end of said second permanent magnet when said second permanent magnet is at said first limit position, said first pole of said first auxiliary magnet magnetically attracting said first pole of said second permanent magnet;

a first pole of said second auxiliary permanent magnet is positioned in close proximity to said first end of said second permanent magnet when said second permanent magnet is at said second limit position, said first pole of said second auxiliary magnet magnetically attracting said pole of said second permanent magnet; and a first pole of said third auxiliary permanent magnet is positioned in close proximity to a second end of said second permanent magnet when said second permanent magnet is between said two limit positions, said first pole of said third auxiliary magnet magnetically repelling said second pole of said second permanent magnet.

4. The indicator of claim 3 wherein said third auxiliary permanent magnet is positioned in close proximity to the second end of said second permanent magnet when said second permanent magnet is substantially at the midpoint between said two limit positions.

5. The indicator of claim 3 wherein said third auxiliary permanent magnet is positioned in close proxnimity to the second end of said seoond permanent magnet whe said second permanent magnet is near the midpoint between said two limit positions but closer to said first limit position.

6. The indicator of claim 3 wherein said third auxiliary permanent magnet is positioned in close proximity to the second end of said second permanent magnet when said second permanent magnet is between said two limit positions, said third auxiliary permanent magnet being positioned to be one-sixth offset from the midpoint between said two limit positions, with said third auxiliary permanent magnet being closer to said second end of said second permanent magnet when said second permanent magnet is in said first limit position than when said second permanent magnet is in said second limit position.

7. The indicator of claim 6 wherein said first, second and third auxiliary permanent magnets are discrete magnets and are mounted within said housing.

8. The indicator of claim 6 wherein said first, second and third auxiliary permanent magnets are magnetized portions of a magnetically spotted ring which is mounted within said housing.

9. A binary indicator providing a means for indicating a normal condition and a fault or malfunction condition of apparatus being monitored comprising:

a housing;

an indicator assembly received by said housing and including an indicator disc rotatably supported on a central axis of said housing whereby when said indicator disc is in a first bistable disposition said indicator assembly indicates one of said conditions and whereby when said indicator disc is in a second bistable disposition said indicator assembly indicates the second of said conditions;

means mounting said indicator disc for movement about an axis of said housing in opposite rotational directions through less than a full turn between said first and second bistable dispositions;

condition responsive means in said housing responsive to a change of at least momentary duration from said normal condition;

means cooperating both with said condition responsive means and mounting means to impart rotational impetus to said indicator disc whereby said indicator disc relocates from one to the other of said bistable dispositions upon occurrence of said change in condition of said apparatus;

resetting means for resetting said indicator disc to said first bistable disposition so that said indicator disc may thereafter relocate to said second bistable disposition upon a subsequent change in condition of said apparatus, said resetting means being carried by said housing and adapted to be rotated from a first limiting position, said resetting means including means for imparting rotational impetus to said indicator disc to return to said first bistable disposition when said resetting means shall have been rotated to a second limiting position;

means biasing said resetting means toward said first limiting position;

window means for viewing a display definitive of said condition on said indicator disc, said window means being carried by said resetting means and coaxial with said indicator disc;

a permanent magnet having two ends disposed along a polar axis substantially normal to said central axis of said housing and having two magnetic poles disposed along said polar axis;

means supporting said permanent magnet for rotation about said central axis between first and second limit positions, said permanent magnet supporting said indicator disc and moving said disc between said first and second limit positions which define said first and second bistable dispositions, respectively, said permanent magnet being driven from said first to said second bistable disposition by said condition responsive means; and auxiliary magnet latching means for aiding in magnetically latching said permanent magnet in one of said limit positions, said auxiliary magnetic means comprising a plurality of auxiliary permanent magnetx, the magnetic fields of said plurality of auxiliary magnets acting upon said permanent magnet so as to latch said permanent magnet in one of said two limit positions until said condition responsive means or said resetting means is activated.

10. The indicator of claim 9 wherein said auxiliary magnetic latching means comprises:

a first auxiliary permanent magnet having two magnetic poles and positioned in close proximity to a first end of said permanent magnet when said permanent magnet is at said first limit position;

a second auxiliary permanent magnet having two magnetic poles and positioned in close proximity to said first end of said permanent magnet when said permanent magnet is at said second limit position; and a third auxiliary permanent magnet having two magnetic poles and positioned in close proximity to a second end of said permanent magnet when said permanent magnet is between said two limit positions.

11. The indicator of claim 10 wherein:

said permanent magnet is disposed so that a first magnetic pole of said permanent magnet is located at said first end of said permanent magnet and a second magnetic pole of said permanent magnet is located at said second end of said permanent magnet;

a first pole of said first auxiliary permanent magnet is positioned in close proximity to a first end of said permanent magnet when said permanent magnet is at said first limit position, said first pole of said first auxiliary magnet magnetically attracting said first pole of said permanent magnet;

a first pole of said second auxiliary permanent magnet is positioned in close proximity to said first end of said permanent magnet when said permanent magnet is at said second limit position, said first pole of said second auxiliary magnet magnetically attracting said first pole of said permanent magnet; and a first pole of said third auxiliary permanent magnet is positioned in close proximity to a second end of said permanent magnet when said permanent magnet is between said two limit positions, said first pole of said third auxiliary magnet magnetically repelling said second pole of said permanent magnet.

12. The indicator of claim 11 wherein said third auxiliary permanent magnet is positioned in close proximity to the second end of said permanent magnet when said permanent magnet is substantially at the midpoint between said two limit positions.

13. The indicator of claim 11 wherein said third auxiliary permanent magnet is positioned in close proximity to the second end of said permanent magnet when said permanent magnet is near the midpoint between said two, limit positions but closer to said first limit position.

14. The indicator of claim 11 wherein said third auxiliary permanent magnet is positioned in close proximity to the second end of said second permanent magnet when said second permanent magnet is between said two limit positions, said third auxiliary permanent magnet being positioned to be one-sixth offset from the midpoint between said two limit positions, with said third auxiliary permanent magnet being closer to said second end of said second permanent magnet when said second permanent magnet is in said first limit position than when said second permanent magnet is in said second limit position.

15. The indicator of claim 14 wherein said first, second and third auxiliary permanent magnets are discrete magnets and are mounted within said housing.

16. The indicator of claim 14 wherein said first, second and third auxiliary permanent magnets are magnetized portions of a magnetically spotted ring which is mounted within said housing.

* * * * *